US010882314B2

(12) United States Patent
Shimotsusa et al.

(10) Patent No.: US 10,882,314 B2
(45) Date of Patent: Jan. 5, 2021

(54) LIQUID EJECTION HEAD, METHOD FOR PRODUCING LIQUID EJECTION HEAD, AND LIQUID EJECTION APPARATUS

(71) Applicant: CANON KABUSHIKI KAISHA, Tokyo (JP)

(72) Inventors: Mineo Shimotsusa, Machida (JP); Shinya Iwahashi, Oita (JP); Sadayoshi Sakuma, Yokohama (JP); Ichiro Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/654,341

(22) Filed: Oct. 16, 2019

(65) Prior Publication Data

US 2020/0122459 A1 Apr. 23, 2020

(30) Foreign Application Priority Data

Oct. 18, 2018 (JP) ..... 2018-196453

(51) Int. Cl.

| | |
|---|---|
| ***B41J 2/045*** | (2006.01) |
| ***B41J 2/05*** | (2006.01) |
| ***B41J 2/14*** | (2006.01) |
| ***B41J 2/475*** | (2006.01) |
| ***B41J 2/335*** | (2006.01) |

(52) U.S. Cl.

CPC ..... *B41J 2/04563* (2013.01); *B41J 2/0458* (2013.01); *B41J 2/04501* (2013.01); *B41J 2/05* (2013.01); *B41J 2/14088* (2013.01); *B41J 2/33535* (2013.01); *B41J 2/4753* (2013.01)

(58) Field of Classification Search

CPC ..... B41J 2/04563; B41J 2/0458; B41J 2/05; B41J 2/14088; B41J 2/14153

See application file for complete search history.

(56) References Cited

U.S. PATENT DOCUMENTS

| | | | | |
|---|---|---|---|---|
| 6,382,773 | B1 * | 5/2002 | Chang et al. | B41J 2/05 |
| 7,306,327 | B2 | 12/2007 | Sakai et al. | |
| 7,591,071 | B2 | 9/2009 | Ibe et al. | |
| 7,641,316 | B2 | 1/2010 | Sakai et al. | |
| 7,681,993 | B2 | 3/2010 | Ono et al. | |
| 7,712,875 | B2 | 5/2010 | Shibata et al. | |
| 7,980,656 | B2 | 7/2011 | Sakurai et al. | |
| 8,033,631 | B2 | 10/2011 | Kanno | |
| 8,152,279 | B2 | 4/2012 | Sakuma et al. | |
| 8,172,371 | B2 | 5/2012 | Ishida et al. | |
| 8,291,576 | B2 | 10/2012 | Ibe et al. | |
| 8,449,080 | B2 | 5/2013 | Shibata et al. | |
| 9,308,722 | B2 | 4/2016 | Ishida et al. | |
| 9,682,552 | B2 | 6/2017 | Kato et al. | |
| 2007/0291081 | A1 * | 12/2007 | Kanno et al. | B41J 2/05 |

FOREIGN PATENT DOCUMENTS

WO 2010/146655 A1 12/2010

* cited by examiner

*Primary Examiner* — Matthew Luu
*Assistant Examiner* — Kendrick X Liu
(74) *Attorney, Agent, or Firm* — Venable LLP

(57) ABSTRACT

A liquid ejection head and its manufacturing method are capable of reducing the thickness of a protective layer as compared to the traditional technique so as to efficiently transfer the heat energy generated by a heating resistance element to a droplet of liquid such as ink. To achieve this, power supply wirings are provided in the same layer below the heating resistance element.

15 Claims, 5 Drawing Sheets

LIQUID EJECTION HEAD, METHOD FOR PRODUCING LIQUID EJECTION HEAD, AND LIQUID EJECTION APPARATUS

BACKGROUND OF THE INVENTION

Field of the Invention

The present invention relates to a liquid ejection head that ejects liquid by the action of a heating resistance element, a method for producing the liquid ejection head, and a liquid ejection apparatus.

Description of the Related Art

WO2010/146655 discloses a print element head having a temperature detecting element provided below a heating resistance element (print element) with an interlayer insulating film of SiO, etc., interposed therebetween, and having a passivation film and an anti-cavitation film provided above the heating resistance element.

In the configuration disclosed in WO2010/146655, a wire connected to the temperature detecting element and a wire connected to the print element cause a two-level difference to be formed on the heating resistance element. In a typical semiconductor process, the thickness of an insulator to sufficiently cover the level difference caused by the wires needs to be equivalent to the level difference caused by the wires.

As disclosed in WO2010/146655, in a case where the level difference is formed on the heating resistance element, the surface of the heating resistance element cannot be sufficiently protected unless the passivation film and the anti-cavitation film are formed to have the same thickness as the formed level difference. In this case, there is a problem that thermal energy emitted from the heating resistance element cannot be efficiently transmitted to a droplet of liquid such as ink because the film thickness needs to be as great as the level difference, resulting in a poor ejection efficiency.

SUMMARY OF THE INVENTION

Accordingly, the present invention provides a liquid ejection head having an excellent ejection efficiency, a method for producing the liquid ejection head, and a liquid ejection apparatus.

The liquid ejection head according to the present invention includes: a substrate; an insulating layer provided on a side of a surface of the substrate; an energy generating element provided in contact with a surface of the insulating layer for generating thermal energy for ejecting liquid; a temperature detecting element provided inside the insulating layer and provided so as to at least partly overlap the energy generating element as viewed from a direction perpendicular to the surface of the substrate; a protective layer that covers a surface of the energy generating element; a first wire that is in contact with a back surface of the energy generating element, the back surface being on a side opposite to the surface of the energy generating element; and a second wire connected to the temperature detecting element, wherein the first wire and the second wire are disposed in a recess provided on the surface of the insulating layer and are located in a same position in the direction perpendicular to the surface of the substrate.

According to the present invention, it is possible to achieve a liquid ejection head having an excellent ejection efficiency, a method for producing the liquid ejection head, and a liquid ejection apparatus.

Further features of the present invention will become apparent from the following description of exemplary embodiments with reference to the attached drawings.

DESCRIPTION OF THE EMBODIMENTS

First Embodiment

Figure 1A:
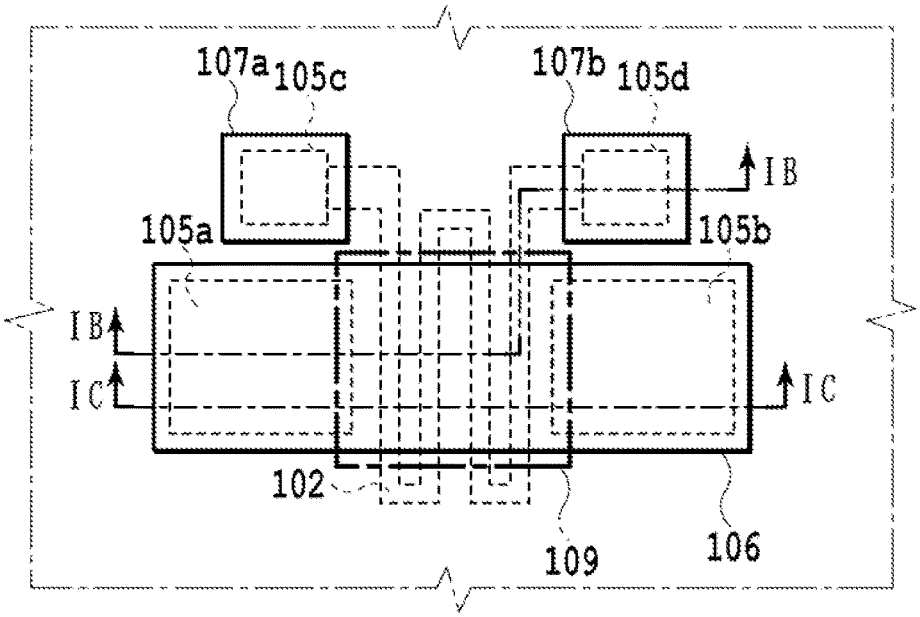
FIG. 1A is a plan view schematically showing a portion of a liquid ejection head.

With reference to the drawings, a first embodiment of the present invention will be described. In the following description, a plurality of figures may be referred to. Furthermore, the same reference numeral refers to the identical component or a similar component, and repeated description of the component with the same reference numeral will be appropriately omitted. Unless otherwise specified, the term "above/on" means in a liquid ejection direction in the liquid ejection head, and the term "below" means a direction opposite to the liquid ejection direction. Further, the terms "top surface" and "surface" as for the liquid ejection head and the components forming the liquid ejection head mean a surface on a side from which liquid is ejected in the liquid ejection head.

Figure 1B:
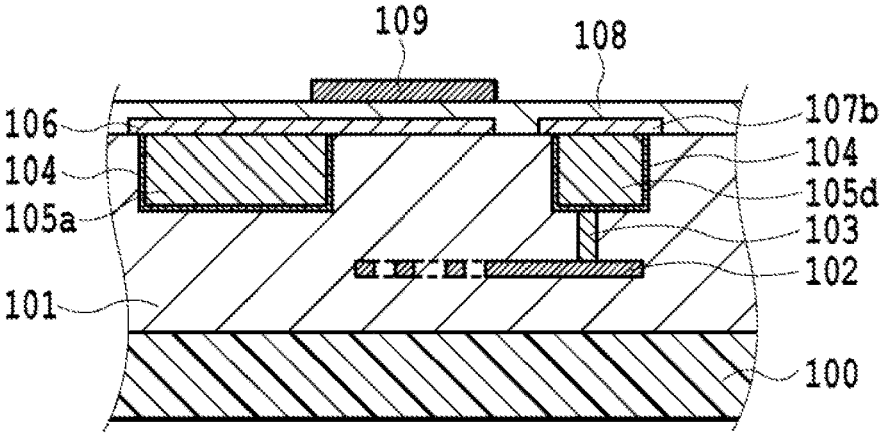
FIG. 1B is a cross-sectional view schematically showing a portion of a liquid ejection head.
Figure 1C:
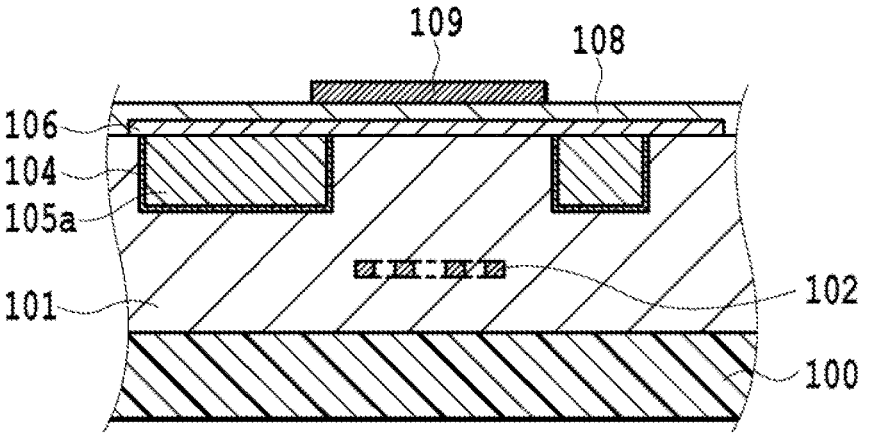
FIG. 1C is a cross-sectional view schematically showing a portion of a liquid ejection head.

FIG. 1A to FIG. 1C schematically show a portion of a liquid ejection head in the present embodiment. FIG. 1A is a plan view and FIG. 1B is a cross-sectional view taken along IB-IB in FIG. 1A. FIG. 1C is a cross-sectional view taken along line IC-IC in FIG. 1A. The liquid ejection head is formed by using a substrate 100 (base) of monocrystalline silicon, for example. An insulating layer 101 is disposed on the substrate 100, and the insulating layer 101 is formed of inorganic material such as silicon oxide and has electric insulation. On the substrate 100, a driving circuit or a control circuit (not shown) is formed. The insulating layer 101 is provided with a connection line connected to the circuit formed on the substrate 100.

On the top surface of the insulating layer 101, power supply wires 105*a*, 105*b*, 105*c*, 105*d* are disposed in an embedded manner. Between the power supply wires 105*a*, 105*b*, 105*c*, 105*d* and the insulating layer 101, a barrier metal 104 is disposed. In other words, the power supply wires 105*a*, 105*b*, 105*c*, 105*d* are arranged in a recess provided in the insulating layer 101. The power supply wires 105*a*, 105*b*, 105*c*, 105*d* are made of metal material including, for example, aluminum or copper, as a main component. The top surfaces of the power supply wires 105*a*, 105*b*, 105*c*, 105*d* and the insulating layer 101 are subjected to planarization processing to form a flat surface (plane surface). The planarization processing is performed by, for example, chemical mechanical polishing (CMP).

On the top surface of the insulating layer 101, a heating resistance element (energy generating element) 106 is formed to be electrically connected to both of the power supply wires 105*a*, 105*b*. A back surface of the heating resistance element 106, which is on a side opposite to the surface of the heating resistance element 106, is provided to be in contact with the top surface of the power supply wires 105*a*, 105*b* and the top surface of the insulating layer 101. Below the heating resistance element 106, the power supply wires 105*a*, 105*b*, 105*c*, 105*d* are provided. The heating resistance element 106 functions as a resistor between the power supply wire 105*a* and the power supply wire 105*b*. The heating resistance element 106 is formed of resistive material such as tantalum silicon nitride and tungsten silicon nitride.

On the top surface of the insulating layer 101 and on the power supply wires 105*c*, 105*d*, it is preferable to dispose cap layers 107*a*, 107*b*, which are made of the same material as the heating resistance element 106 and disposed in the same layer as the heating resistance element 106, for protecting the power supply wires 105*c*, 105*d* in etching the heating resistance element 106. Further, in a case where the power supply wires 105*a*, 105*b*, 105*c*, 105*d* are formed of metal material including copper as a main component, the cap layers 107*a*, 107*b* can prevent diffusion of copper together with the barrier metal 104.

On the heating resistance element 106 and the cap layers 107*a*, 107*b*, a protective layer 108 is disposed. The protective layer 108 is formed of inorganic material such as silicon nitride and has electric insulation. On the protective layer 108 and above a heating portion of the heating resistance element 106, an anti-cavitation layer 109 is disposed.

Inside the insulating layer 101 and below the heating resistance element 106, a temperature detecting element 102 is provided to detect a temperature of the heating resistance element 106 (a surface temperature of the anti-cavitation layer 109) via the insulating layer 101. As viewed from the direction perpendicular to the surface of the silicon substrate 100, the temperature detecting element 102 is provided so as to at least partly overlap the heating resistance element 106. The temperature detecting element 102 is electrically connected to the power supply wires 105*c*, 105*d* via a plug (connection member) 103, and functions as a temperature detecting sensor between the power supply wire 105*c* and the power supply wire 105*d*. The liquid ejection head is provided with a plurality of heating resistance elements 106 and a plurality of temperature detecting elements 102.

The power supply wires 105*a*, 105*b*, 105*c*, 105*d* are formed to have a thickness of 1000 nm, for example. The heating resistance element 106 is formed to have a thickness of 10 to 50 nm, for example. The temperature detecting element 102 is formed of material having a large temperature coefficient of resistance such as titanium, silicon, tantalum silicon nitride, and tungsten silicon nitride, or an alloy in a single layer or a stacked layer. The temperature detecting element 102 is formed to have a thickness of 10 to 50 nm, for example. The anti-cavitation layer 109 is formed of metal having a high melting point with an excellent heat resistance such as tantalum and iridium, in a single layer or a stacked layer. The anti-cavitation layer 109 is formed to have a thickness of 30 to 250 nm, for example. The protective layer 108 is formed to have a thickness of 50 to 200 nm (equal to or less than 300 nm), for example, and insulates the heating resistance element 106 and the power supply wires 105*a*, 105*b* from the anti-cavitation layer 109.

In the present embodiment, the heating resistance element 106 and the temperature detecting element 102 are connected to the power supply wires in the same layer. That is, the heating resistance element 106 and the temperature detecting element 102 are connected to the power supply wires located in the same position in the direction perpendicular to the surface of the silicon substrate 100, that is, the same level. Furthermore, since the power supply wires are embedded in the insulating layer 101 between the heating resistance element 106 and the temperature detecting element 102, no wire exists below the temperature detecting element 102 and there is no level difference caused by the wires. In addition, no wire exists above the heating resistance element 106, and there is no level difference caused by the wires on the top surface of the heating resistance element 106 on which the protective layer 108 is formed. Since the present invention has a configuration without a level difference, it is possible to reduce the thickness of the protective layer 108 as compared to the traditional technique, allowing thermal energy generated by the heating resistance element 106 to be efficiently transmitted to a droplet of liquid such as ink.

It should be noted that the present invention has been described as a liquid ejection head, but may be applicable to a liquid ejection apparatus capable of using the liquid ejection head.

As described above, in the same layer below the heating resistance element 106, the power supply wires 105*a*, 105*b*, 105*c*, 105*d* are provided. Accordingly, it is possible to achieve a liquid ejection head having an excellent ejection efficiency and a method for producing the liquid ejection head.

Second Embodiment

With reference to the drawings, a second embodiment of the present invention will be described. It should be noted that since the basic configuration of the present embodiment is the same as that of the first embodiment, only a characteristic configuration will be described.

Figure 2A:
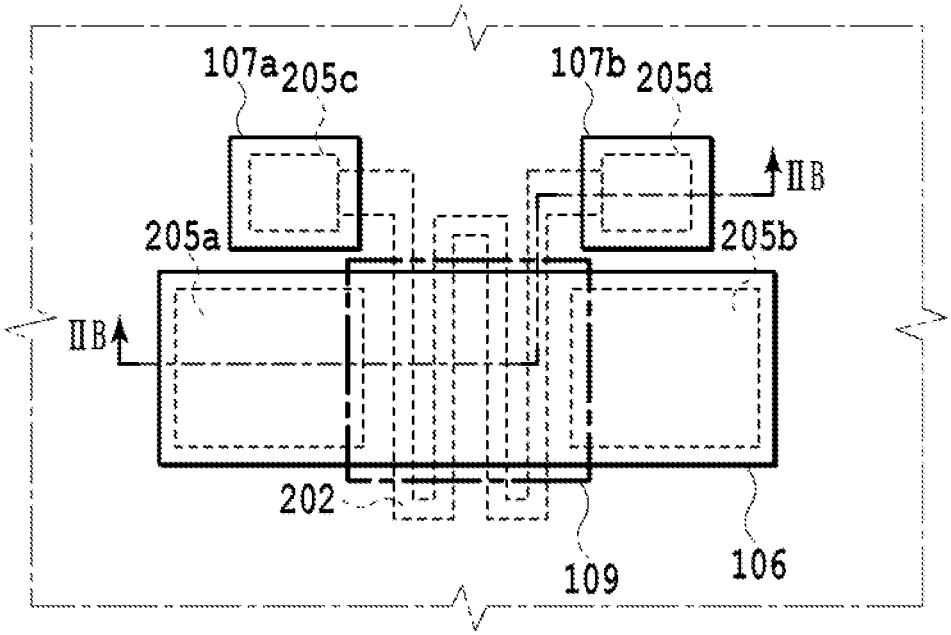
FIG. 2A is a plan view schematically showing a portion of a liquid ejection head.
Figure 2B:
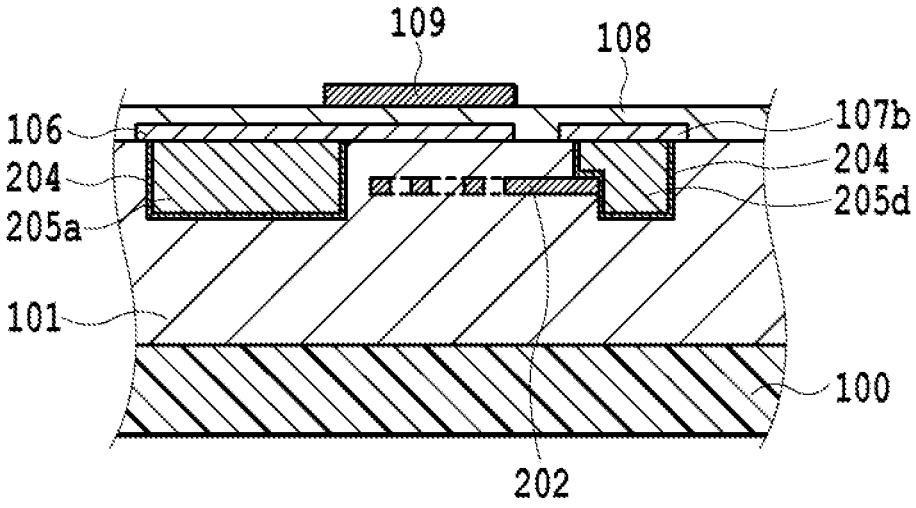
FIG. 2B is a cross-sectional view schematically showing a portion of a liquid ejection head.

FIG. 2A and FIG. 2B schematically show a portion of a liquid ejection head in the present embodiment. FIG. 2A is a plan view and FIG. 2B is a cross-sectional view taken along line IIB-IIB in FIG. 2A. In the present embodiment, a short distance is set between a heating resistance element and a temperature detecting element and production steps are simplified. An example of such an aspect will be described.

A temperature detecting element 202 is electrically connected to power supply wires 205*c*, 205*d* via a barrier metal 204, and functions as a temperature detecting sensor between the power supply wire 205*c* and the power supply wire 205*d*. The temperature detecting element 202 of the present embodiment is provided in a position closer to a heating resistance element 106 as compared to the first embodiment. The temperature detecting element 202 is electrically connected to the power supply wires 205*c*, 205*d* in direct connection in a position within an area of the power supply wires 205*c*, 205*d* in a thickness direction. No particular connection line is used such as a contact plug as used in the first embodiment. For this reason, there is no need to form a contact plug, and single damascene etching for forming individual wires can be used for formation. Since there is no need to form a contact plug for the connection with the temperature detecting element 202, it is possible to simplify the production steps.

Furthermore, since a short distance is set between the heating resistance element 106 and the temperature detecting element 202 in the present embodiment, the temperature detecting element 202 can acquire temperature information about the heating resistance element 106 with high sensitivity. Furthermore, since a short distance can be set between the temperature detecting element 202 and the surface of a thermal action portion (the surface of an anti-cavitation layer 109 in the present embodiment) located above the heating resistance element 106 for being in contact with liquid, the temperature detecting element 202 can acquire temperature information on the surface of the thermal action portion with high sensitivity.

It should be noted that description of the connection with a driving circuit or a control circuit will be omitted.

Third Embodiment

With reference to the drawings, a third embodiment of the present invention will be described. It should be noted that since the basic configuration of the present embodiment is the same as that of the first embodiment, only a characteristic configuration will be described.

Figure 3A:
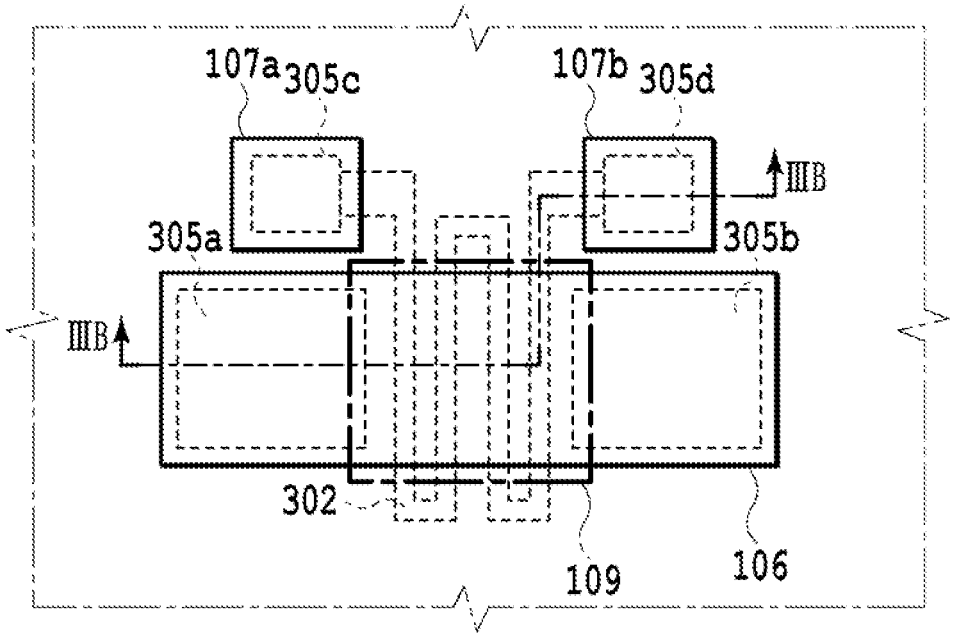
FIG. 3A is a plan view schematically showing a portion of a liquid ejection head.
Figure 3B:
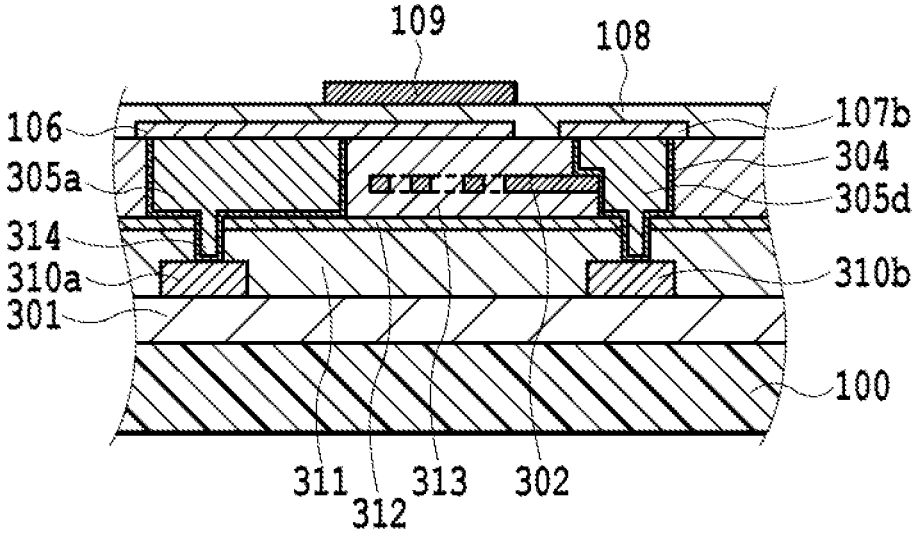
FIG. 3B is a cross-sectional view schematically showing a portion of a liquid ejection head.

FIG. 3A and FIG. 3B schematically show a portion of a liquid ejection head in the present embodiment. FIG. 3A is a plan view and FIG. 3B is a cross-sectional view taken along line IIIB-IIIB in FIG. 3A. In the present embodiment, production steps are further simplified. An example of such an aspect will be described.

A first insulating layer 301 is disposed on a substrate 100. The first insulating layer 301 is formed of inorganic material such as silicon oxide and has electric insulation. A driving circuit or a control circuit (not shown) is formed on the substrate 100, and the first insulating layer 301 is provided with a connection line connected to the circuits formed on the substrate 100. Intermediate wires 310*a*, 310*b* are disposed on the first insulating layer 301. The intermediate wires 310*a*, 310*b* are formed of metal material including, for example, aluminum as a main component.

The intermediate wires 310*a*, 310*b* are connected to the driving circuit or the control circuit (not shown). A second insulating layer 311, a third insulating layer 312, and a fourth insulating layer 313 are disposed on the intermediate wires 310*a*, 310*b*. The second insulating layer 311 and the fourth insulating layer 313 are formed of inorganic material such as silicon oxide and the third insulating layer 312 is formed of inorganic material such as silicon nitride and silicon carbide, all of which have electric insulation.

Power supply wires 305*a*, 305*b*, 305*c*, 305*d* are disposed in the second insulating layer 311, the third insulating layer 312, and the fourth insulating layer 313. A via 314 electrically connecting the power supply wires 305*a*, 305*b*, 305*c*, 305*d* and the intermediate wires 310*a*, 310*b* is disposed in the fourth insulating layer 313. The power supply wires 305*a*, 305*b*, 305*c*, 305*d* and the via 314 are formed of the same material, for example, metal material including copper as a main component. A barrier metal 304 is disposed between the power supply wires 305*a*, 305*b*, 305*c*, 305*d* and via 314 and the second insulating layer 311, third insulating layer 312, and fourth insulating layer 313.

A temperature detecting element 302 is disposed below a heating resistance element 106 via the fourth insulating layer 313. The temperature detecting element 302 is formed of material having a large temperature coefficient of resistance such as titanium, tungsten, silicon, and tantalum silicon nitride, or an alloy in a single layer or a stacked layer. The temperature detecting element 302 is formed to have a thickness of 10 to 50 nm, for example. The temperature detecting element 302 is electrically connected to the power supply wires 305*c*, 305*d* via the barrier metal 304 and functions as a temperature detecting sensor between the power supply wire 305*c* and the power supply wire 305*d*.

In the present embodiment, the temperature detecting element 302 is electrically connected to the power supply wires 305*c*, 305*d* in a position within an area of the power supply wires 305*c*, 305*d* in a thickness direction. No particular connection line is used such as a contact plug as used in the first embodiment. In addition, the power supply wires 305*a*, 305*b*, 305*c*, 305*d* and the intermediate wires 310*a*, 310*b* are electrically connected to each other by the via 314 made of the same material as the power supply wires 305*a*, 305*b*, 305*c*, 305*d*.

FIG. 4A to FIG. 4D and FIG. 5A to FIG. 5D are cross-sectional schematic views showing a method for producing the liquid ejection head shown in FIG. 3B. With reference to FIG. 4A to FIG. 4D and FIG. 5A to FIG. 5D, the method for producing the liquid ejection head will be described in step order.

Figure 4A:
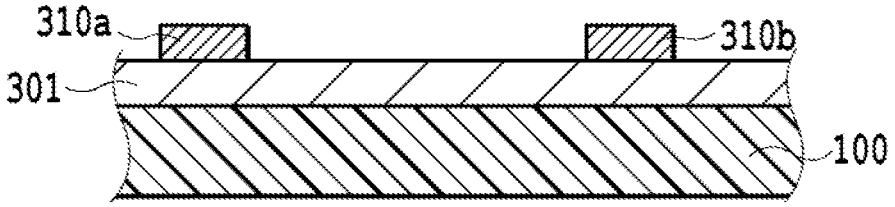
FIG. 4A is a cross-sectional schematic view showing a method for producing a liquid ejection head.

First, as shown in FIG. 4A, a thin film of the first insulating layer 301 of silicon oxide is deposited by CVD on the substrate 100 made of monocrystalline silicon. A thin film of metal material including aluminum as a main component is deposited on the first insulating layer 301 by sputtering and patterned to form the intermediate wires 310*a*, 310*b*.

Figure 4B:
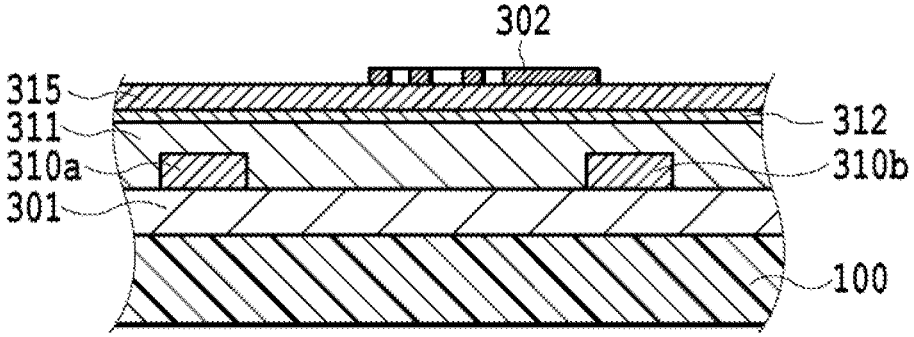
FIG. 4B is a cross-sectional schematic view showing a method for producing a liquid ejection head.

Then, as shown in FIG. 4B, a thin film of silicon oxide is deposited on the intermediate wires 310*a*, 310*b* by CVD and planarized by CMP to form the second insulating layer 311. A thin film of silicon nitride is deposited on the second insulating layer 311 by CVD to form the third insulating layer 312. A thin film of silicon oxide is deposited on the third insulating layer 312 by CVD to form the adjustment insulating layer 315. Then, a thin film of material having a large temperature coefficient of resistance such as tantalum silicon nitride is deposited by sputtering and patterned to form the temperature detecting element 302 (temperature detecting element formation step).

The adjustment insulating layer 315 may not be needed in the end because it serves to adjust a distance between the heating resistance element and the temperature detecting element. For example, in a case where a distance between the heating resistance element and the temperature detecting element is set to be substantially equal to the thickness of the power supply wire, the adjustment insulating layer 315 may not be needed. Furthermore, the temperature detecting element 302 may be used instead of the third insulating layer 312, and in this case, the third insulating layer 312 may not be needed, either.

Figure 4C:
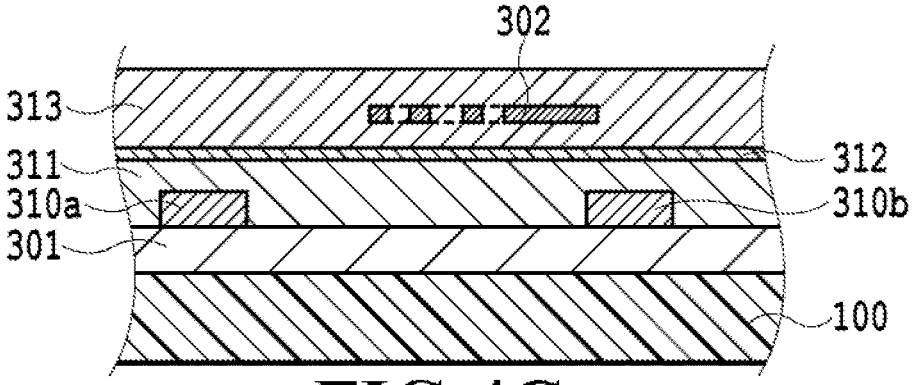
FIG. 4C is a cross-sectional schematic view showing a method for producing a liquid ejection head.

Then, as shown in FIG. 4C, a thin film of silicon oxide is deposited on the temperature detecting element 302 by CVD and planarized by CMP to form the fourth insulating layer 313. Since the temperature detecting element 302 has a thickness of 10 to 50 nm, CMP may not always be needed.

Figure 4D:
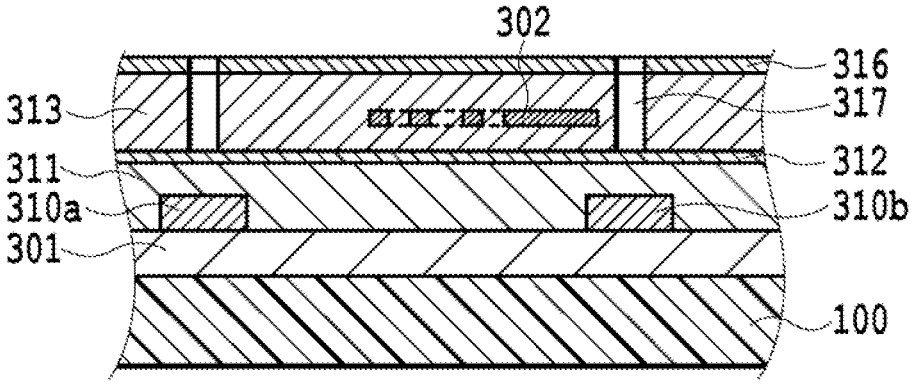
FIG. 4D is a cross-sectional schematic view showing a method for producing a liquid ejection head.

As shown in FIG. 4D, a first photoresist 316 is patterned on the fourth insulating layer 313, and the fourth insulating layer 313 is etched while using the third insulating layer 312 as a stop material to form a via 317.

Figure 5A:
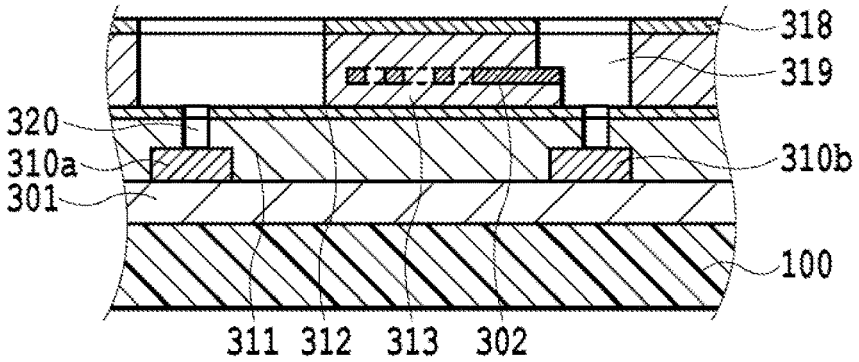
FIG. 5A is a cross-sectional schematic view showing a method for producing a liquid ejection head.

Next, as shown in FIG. 5A, the first photoresist 316 on the fourth insulating layer 313 is removed, a second photoresist 318 is patterned, and the fourth insulating layer 313 is etched while using the third insulating layer 312 and the temperature detecting element 302 as a stop material to form a trench 319. Furthermore, the second insulating layer 311 is etched to the intermediate wires 310*a*, 310*b* to form a via 320. The via 320 can be formed by using via-first dual damascene etching for continuously forming a trench, which will serve as a via and a wire, and embedding copper at the same time. By using the dual damascene etching, the wire and the via may be formed of the same type of metal at the same time. Accordingly, it is possible to simplify the production steps by not using a particular connection line such as a contact plug for the connection between the temperature detecting element 302 and the power supply wires 305*c*, 305*d* and further by using the dual damascene etching for the connection with the intermediate wire.

Note that in etching, the temperature detecting element 302 may not always need to function as a stop material as long as a side wall of the temperature detecting element 302 is in contact with the trench 319.

Figure 5B:
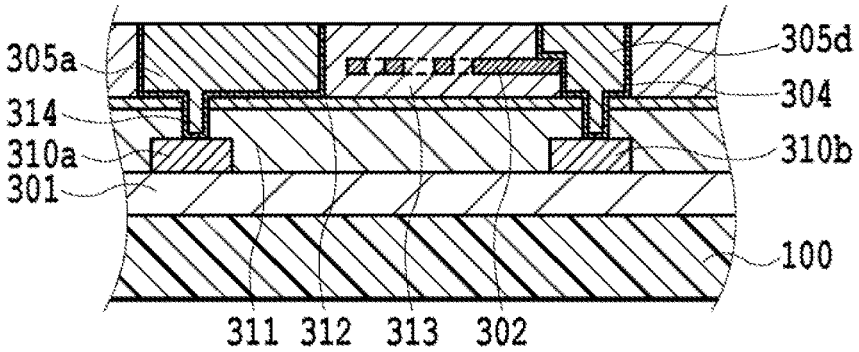
FIG. 5B is a cross-sectional schematic view showing a method for producing a liquid ejection head.

Then, as shown in FIG. 5B, the second photoresist 318 is removed, and a thin film of a seed layer of the barrier metal 304 and copper is deposited by sputtering to plate copper. Next, redundant copper is removed by CMP to form the power supply wires 305*a*, 305*b*, 305*c*, 305*d*, and via 314 (wire formation step). The top surfaces of the power supply wires 305*a*, 305*b*, 305*c*, 305*d* and the fourth insulating layer 313 are planarized by CMP. As a result, the power supply wire 305*a* and the intermediate wire 310*a*, the power supply wire 305*d* and the intermediate wire 310*b*, the temperature detecting element 302 and the power supply wires 305*c*, 305*d* are electrically connected to each other. No particular connection line such as a plug is used for the connection between the temperature detecting element 302 and the power supply wires 305*c*, 305*d*, and self-aligned contact is used for the formation as shown in FIG. 5A.

Figure 5C:
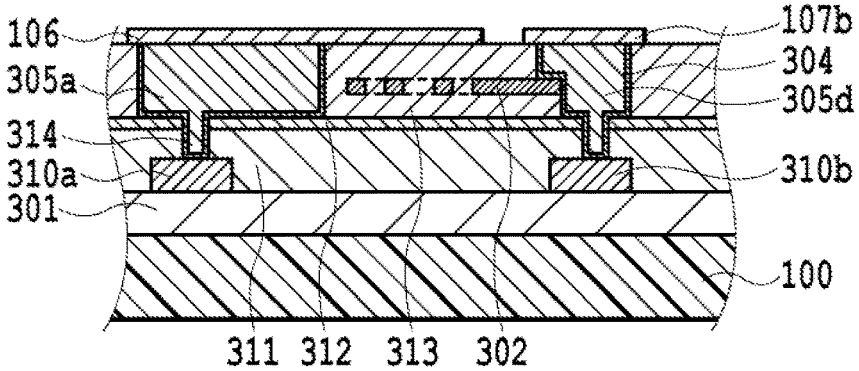
FIG. 5C is a cross-sectional schematic view showing a method for producing a liquid ejection head.

Then, as shown in FIG. 5C, a thin film of tantalum silicon nitride is deposited on the power supply wires 305*a*, 305*b*, 305*c*, 305*d* by sputtering and patterned. Accordingly, the heating resistance element 106 and cap layers 107*a*, 107*b* are formed (energy generating element formation step). As a result, the heating resistance element 106 is electrically connected to the power supply wires 305*a*, 305*b*.

Figure 5D:
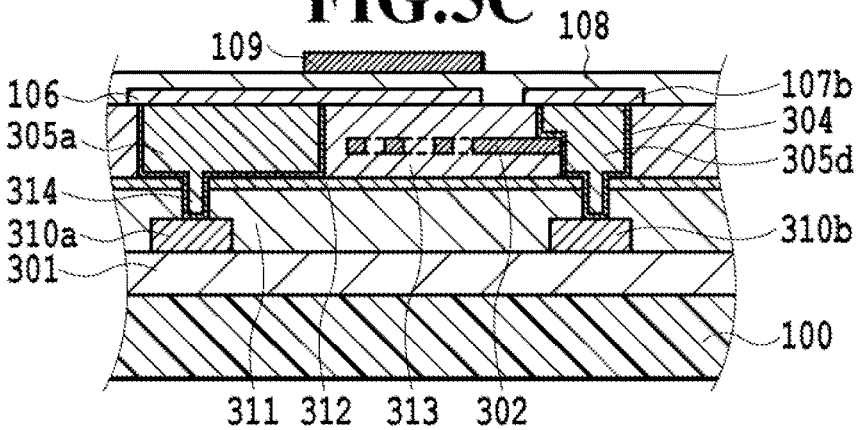
FIG. 5D is a cross-sectional schematic view showing a method for producing a liquid ejection head.

Then, as shown in FIG. 5D, a thin film of silicon nitride is deposited on the heating resistance element 106 by using CVD to form a protective layer 108 (protective layer formation step). In a case where the power supply wires 305*a*, 305*b*, 305*c*, 305*d* are made of metal including copper as a main component, the protective layer 108 functions as a diffusion preventing film together with the heating resistance element 106 and the cap layers 107*a*, 107*b*. Next, a thin film of tantalum is deposited on the protective layer 108 by sputtering and patterned to form an anti-cavitation layer 109. Through the above-described steps, the liquid ejection head of the present embodiment is produced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-196453 filed Oct. 18, 2018, which is hereby incorporated by reference herein in its entirety.

What is claimed is:

1. A liquid ejection head comprising:

a substrate;

an insulating layer provided on a side of a surface of the substrate;

an energy generating element provided in contact with a surface of the insulating layer for generating thermal energy for ejecting liquid;

a temperature detecting element provided inside the insulating layer and provided so as to at least partly overlap the energy generating element as viewed from a direction perpendicular to the surface of the substrate;

a protective layer that covers a surface of the energy generating element;

a first wire that is in contact with a back surface of the energy generating element, the back surface being on a side opposite to the surface of the energy generating element; and a second wire connected to the temperature detecting element, wherein the first wire and the second wire are disposed in a recess provided on the surface of the insulating layer and are located at a same level with respect to the direction perpendicular to the surface of the substrate.

2. The liquid ejection head according to claim 1, wherein a surface of the first wire and the surface of the insulating layer form a plane surface, and the plane surface and the back surface of the energy generating element are in contact with each other.

3. The liquid ejection head according to claim 1, wherein the first wire and the second wire are provided in the insulating layer between the energy generating element and the temperature detecting element.

4. The liquid ejection head according to claim 3, wherein the temperature detecting element and the second wire are connected by a connection member.

5. The liquid ejection head according to claim 1, wherein the temperature detecting element is provided in an area of the second wire in the direction perpendicular to the surface of the substrate.

6. The liquid ejection head according to claim 5, wherein the temperature detecting element and the second wire are in direct connection.

7. The liquid ejection head according to claim 5, further comprising an intermediate wire connected to a driving circuit for driving the energy generating element or a control circuit for controlling driving of the energy generating element.

8. The liquid ejection head according to claim 7, wherein the intermediate wire is connected to the first wire and the second wire by a via, and the via is formed of the same type of metal as the first wire and the second wire.

9. The liquid ejection head according to claim 1, wherein the first wire and the second wire are embedded in the insulating layer.

10. The liquid ejection head according to claim 1, wherein the protective layer has a thickness of equal to or less than 300 nm.

11. The liquid ejection head according to claim 1, wherein the energy generating element includes tantalum or tungsten.

12. The liquid ejection head according to claim 1, comprising an anti-cavitation layer that covers at least a portion of the protective layer and is formed of metal in a single layer or a stacked layer.

13. A method for producing a liquid ejection head, comprising:

a temperature detecting element formation step of forming a temperature detecting element inside an insulating layer;

a wire formation step of forming a recess on a surface of the insulating layer and forming a first wire and a second wire connected to the temperature detecting element in the recess;

an energy generating element formation step of forming an energy generating element that generates thermal energy for ejecting liquid so as to be in contact with a surface of the first wire and the surface of the insulating layer; and a protective layer formation step of forming a protective layer that covers a surface of the energy generating element.

14. The method for producing a liquid ejection head according to claim 13, wherein the second wire and the temperature detecting element are connected by self-alignment.

15. A liquid ejection apparatus capable of using a liquid ejection head comprising:

a substrate;

an insulating layer provided on a side of a surface of the substrate;

an energy generating element provided in contact with a surface of the insulating layer for generating thermal energy for ejecting liquid;

a temperature detecting element provided inside the insulating layer and provided so as to at least partly overlap the energy generating element as viewed from a direction perpendicular to the surface of the substrate;

a protective layer that covers a surface of the energy generating element;

a first wire that is in contact with a back surface of the energy generating element, the back surface being on a side opposite to the surface of the energy generating element; and a second wire connected to the temperature detecting element, wherein the first wire and the second wire are disposed in a recess provided on the surface of the insulating layer and are located at a same level with respect to the direction perpendicular to the surface of the substrate.

* * * * *